United States Patent [19]

Fohl

[11] Patent Number: 4,748,696

[45] Date of Patent: Jun. 7, 1988

[54] SAFETY HELMET

[76] Inventor: Artur Fohl, Auf der Halde 28, 7060 Schorndorf, Fed. Rep. of Germany

[21] Appl. No.: 864,003

[22] Filed: May 16, 1986

[51] Int. Cl.[4] ..... A42B 3/02

[52] U.S. Cl. ..... 2/424; 2/10; 2/425

[58] Field of Search ..... 2/9, 10, 424, 425

[56] References Cited

U.S. PATENT DOCUMENTS

| | | | |
|---|---|---|---|
| 3,423,758 | 1/1969 | Heacox | 2/424 |
| 4,247,960 | 2/1981 | Nava | 2/424 |
| 4,297,747 | 11/1981 | Nava | 2/424 |
| 4,305,160 | 12/1981 | Sundahl | 2/424 |
| 4,312,078 | 1/1982 | Pollitt et al. | 2/424 |
| 4,507,809 | 4/1985 | Stepan | 2/424 |
| 4,536,892 | 8/1985 | Brinkhoff et al. | 2/424 |
| 4,546,498 | 10/1985 | Fantin | 2/424 |

*Primary Examiner*—Louis K. Rimrodt

*Attorney, Agent, or Firm*—Steele, Gould & Fried

[57] ABSTRACT

A safety helmet has a shell with a visor movably supported on both sides. By means of a bearing pin and a control pin guided along cam surfaces, the visor can be positioned over the face opening of the helmet or swung upwardly. Detents for the pins define positions for the visor including a flush mounting in the face opening, a venting position at which the visor is spaced from the helmet shell but remains over the face opening, and an upward position. These positions are preferably achieved by means of a control disc having displacement and rotation defining detents, engaging the bearing and control pins on each side of the visor.

29 Claims, 7 Drawing Sheets

FIG. 6
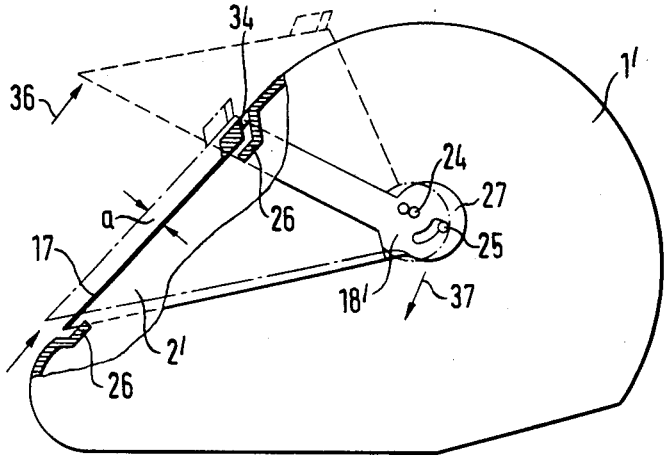
FIG. 7
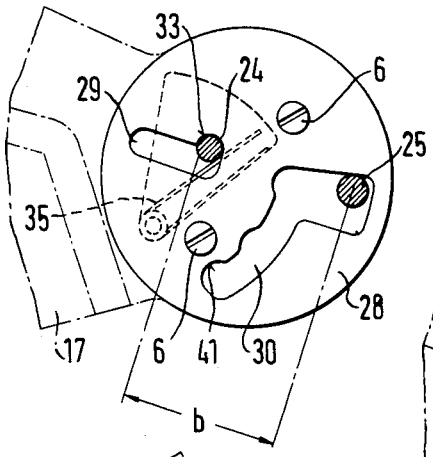
FIG. 8
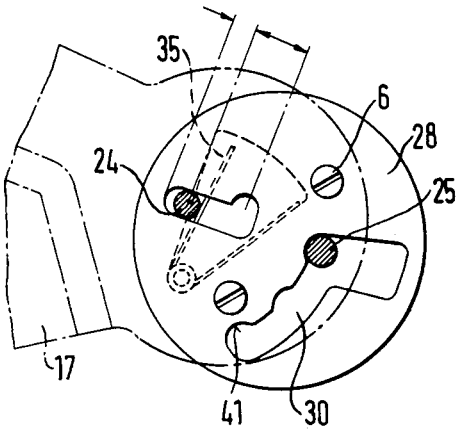
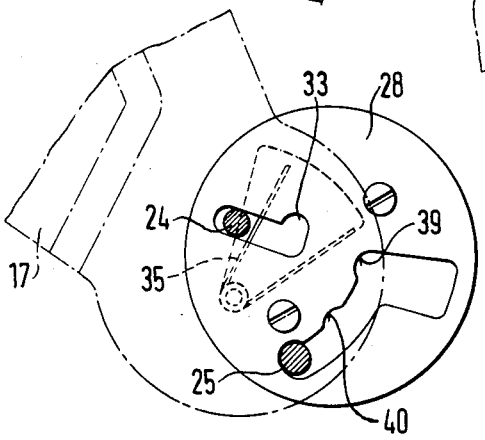
FIG. 9

FIG. 15
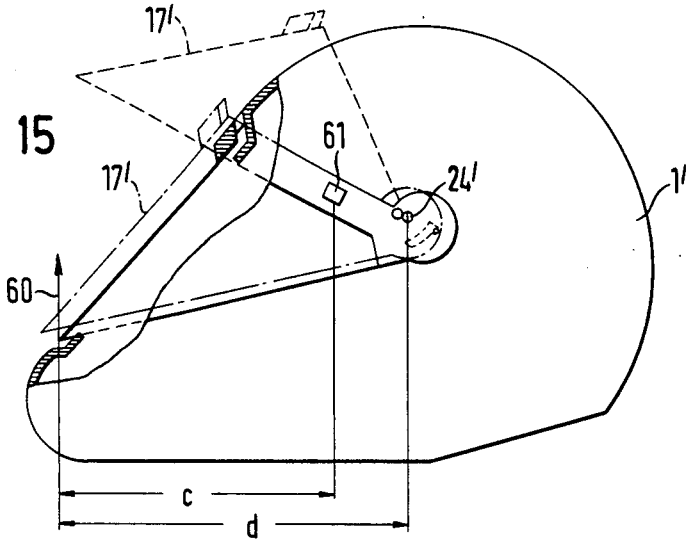
FIG. 20
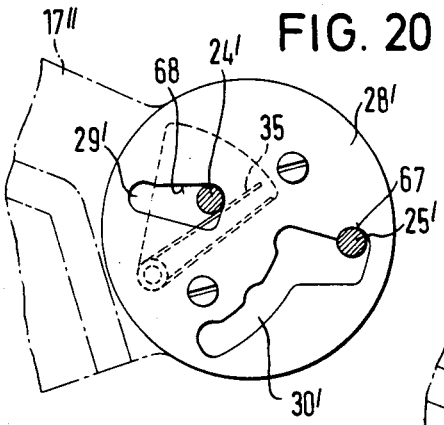
FIG. 21
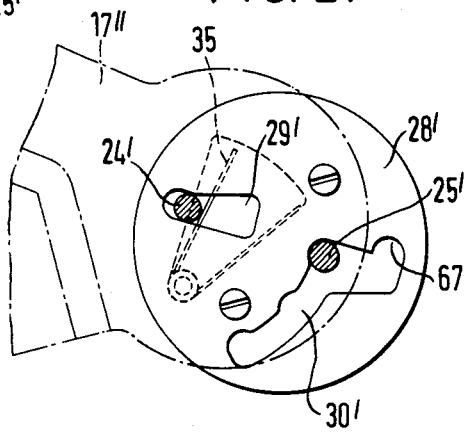
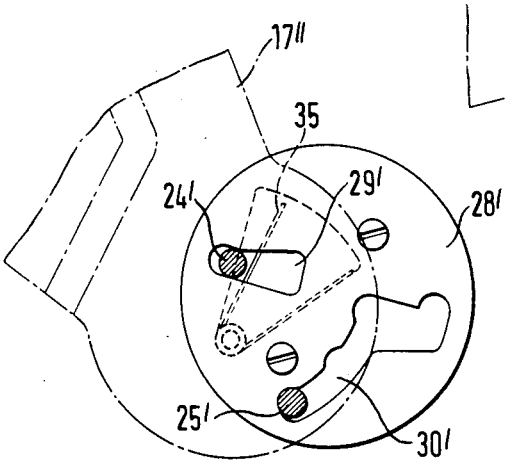
FIG. 22

FIG. 19
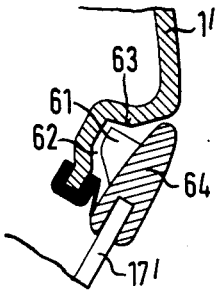
FIG. 16
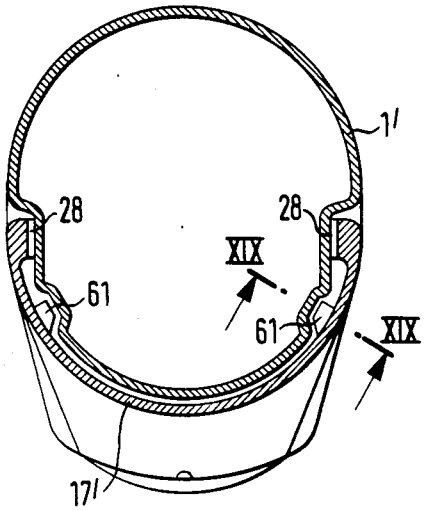
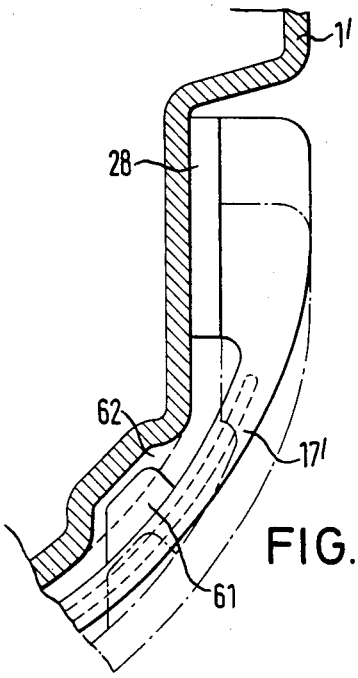
FIG. 18
FIG. 17
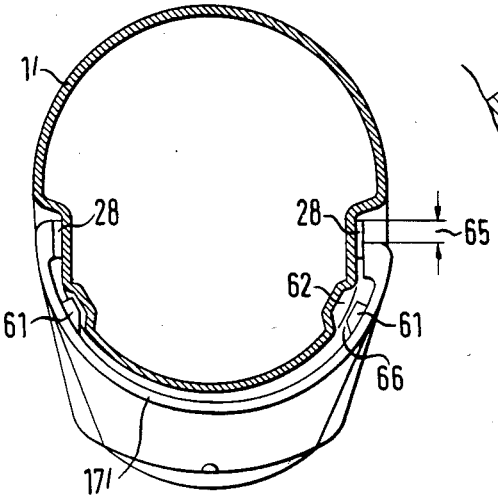

SAFETY HELMET

BACKGROUND OF THE INVENTION

The invention relates to the field of safety helmets, especially to a crash helmet for a motorcycle riders, having a selectively positionable visor.

PRIOR ART

Known safety helmets, especially crash helmets of this type, are basically distinguishable into two types by virtue of their visor placement and visor design. With one type, the visor is placed on (or in) the shell-like body of the helmet, and can be tilted relative to the helmet around two centers of rotation, located opposite one another on both sides of the helmet. To secure or lock the visor into position, radially serrated locking disks under slight axial pressure are provided, with one disk being fixed to the helmet shell and the other disk being fixed to the visor. The visor is secured from the outside with screws or connector bolts through the disks. As a rule, a small projection is provided on the visor for operating the device, spaced away from the center of rotation, or placed on the frame of the visor itself.

In a second type of design, the visor is not only rotatable, but also movable into an opening at the helmet shell, i.e., the visor is retractable into a depression at the cutout for the face. The visor can be raised outwardly from the cutout and is then rotatable around centers of rotation located opposite one another. Therefore, a structure is known whereby the visor frame becomes a hinge that can be movably spaced from its pivot bearing points, and in a closed position the hinge is held on fasteners. When fasteners on the right and left are opened, the visor is movable according to the hinge spacing means, outwardly from its closed position, and can be hinged upwardly without problems.

Other designs are also known, for example in which the visor can be adjusted by means of a hand wheel mounted rigidly on the helmet. Other mechanisms for adjustment are known, including Boden pullwires.

The foregoing designs have certain disadvantages. According to the first design in which serrated locking disks are pressed against one another, the engaged disks, which engage each other under stress, are subject to wear. When the disks are relatively rotated over one another they produce an irritating slipping noise near user's ears. Regarding the second noted design in which the visor is displaceably hingeable, the advantage of the inwardly movable placement of the visor is offset by the disadvantage of the complicated type of mounting and the fastener release requirement. This latter attribute is a significant disadvantage in that during an emergency, for example when the visor is obstructed suddenly by splashed dirt or the like, the visor cannot be released and folded upward quickly enough to ensure necessary safety. The same is true of a hand wheel type visor adjustment.

It is an object of the invention to improve known safety helmets of this general description such that a simple structural design enables quick and safe operation of the visor even in emergencies. It is also an object to achieve this improvement with a device whose usefulness is increased generally.

According to the invention, these objects are achieved by a safety helmet in which the visor is not lockable by axial engagement, but instead is adjustable and lockable by radially-acting means. The advantages thereby achieved that various positions and movements are possible, even in the visor-lowered position. Furthermore, significant advantages according to the invention are provided by the particular design and shaping of the stop surfaces, by which the visor can be set at a number of positions.

A structurally simple embodiment of the invention includes a visor which cannot be lifted outwardly from its operative position, but has a rigid pivoting bearing and as radially-effective control element. According to a second, and preferable design, control surfaces are provided for an inwardly-closed visor such that upon the first rotational movement of the closed visor, the complete visor performs a preliminary movement outwardly, thereby clearing the edge of the helmet shell and becoming rotatable freely over the helmet shell.

Preferably, the control surfaces are such that a radial cam causes a first rotational movement to a fixed position, for example defined by a positioning notch, which vents the visor (i.e. spaces the visor slightly from the helmet), while the visor remains parallel to its closed position at the cutout for the user's face. This provides good ventilation for the user. If the visor is further turned upwardly, intermediate positions may be provided at any point within the rotating or folding path up to the fully-opened visor position. By simply folding down the visor and pressing the visor toward the head, the visor can then be fixed with its closed position automatically. Two guide pins are located opposite one another, and engage by a forward/rearward movable engagement with a radial cam. The forward position defines the subject venting position of the visor and is useful, for example, for a motorcycle rider who makes a brief stop at a stop sign or the like, and desires to vent the helmet. By means of appropriate adjustment of the control elements, for example using a light spring bias on the control elements, the visor can be arranged such that it need not be closed manually at all. Instead, the visor can be closed automatically by the force of the wind against the helmet when the user starts again from the stop sign or the like. The safety helmet design of this invention also does not necessarily require simultaneous operation of separate control elements on opposite sides of the helmet, which simplifies the structural design and structural requirements for the visor.

Within the framework of the invention, there are a number of possibilities regarding the layout of control elements, with exemplary radial cams and control elements being disclosed herein, pivotable either on the helmet shell or on the visor. The invention is capable of embodiment in any of these variations.

BRIEF DESCRIPTION OF THE DRAWINGS

There are shown in the drawings operating examples which are described hereafter in detial. In the drawings.

FIGS. 6–14 illustrate a second embodiment of the invention, as applied to the helmet of FIG. 6, and shown schematically in FIG. 11, FIGS. 9' and 10' being variant embodiment.

FIG. 15 illustrates a helmet according to the invention according to two further embodiments.

FIGS. 16–19 illustrate an alternative embodiment of the device according to FIG. 15, by way of sectional views, FIG. 19 being a sectional view taken along lines XIX—XIX in FIG. 16.

FIGS. 20–22 illustrate a second alternative embodiment, the control disk being shown in various operating positions.

DETAILED DESCRIPTION OF THE PREFERRED EMBODIMENTS

Figure 1:
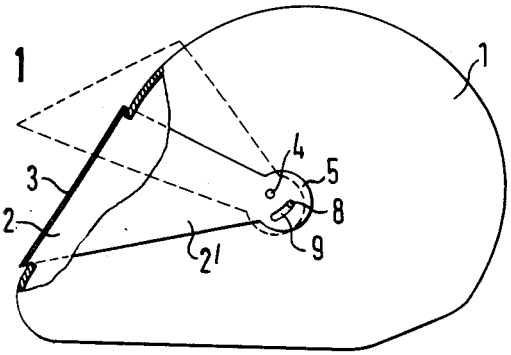
FIGS. 1–5 illustrate a first embodiment of the safety helmet of the invention, FIG. 5 being a variant embodiment, the device being applied to the helmet shown in elevation in FIG. 1.
Figure 2:
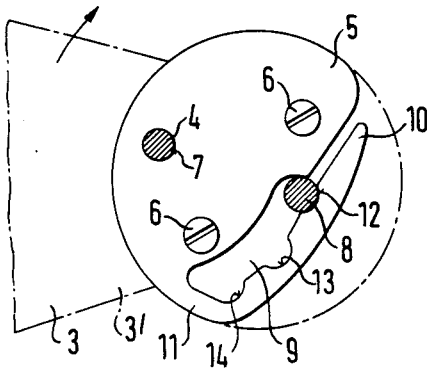

As shown in FIG. 1, a helmet shell 1 of the usual design has a cutout 2 for the user's face. A visor 3 is selectively movable over the cutout for the face, the visor being a transparent resilient material which can be turned upwardly into the dotted-line position around a bearing pivot pin 4. A swivel bearing mount for each of the opposite sides of visor 3 is locted on each of the opposite sides of the helmet shell 1. In the operating example shown in FIG. 1, the visor is attached at the outer surface of the helmet shell 1. In gewneral, the bearing pivot pin 4 is arranged such that when opening the visor 3, the visor can be pushed upwardly into the dotted-line position without any restrictions. A control disk 5 serves as a carrying track for the control element.

Figure 3:
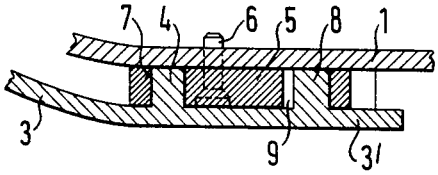

The control disk 5 is illustrated in detail in FIGS. 2–5. A control disk 5 is secured to each opposite side of the helmet 1, in each case using two screws 6. Disk 5 is a springy elastic material. The bearing pivot pin 4 guided in disk 5, is shaped or molded in the side sections 2' of the visor side sections and engages in an opening 7 in the control disks, located off center, as shown in FIG. 3.

Figure 4:
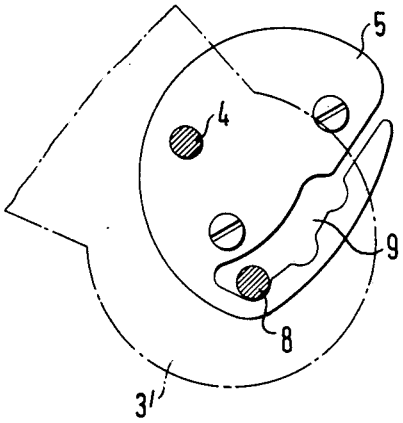

On the outer side 3' of the visor 3, on each side of the essentially U-shaped visor, is a control pivot pin 8. Control pivot pin 8 engages in a radial cam 9, which is shaped as a bearing or control recess in disk 5. Radial cam 9 is essentially concentric with the bearing pivot 4 and is formed on the outer side by a resiliently loaded springy section 10 of the disk 5. Section 10 is connected with disk cam 5 by web 11. Located on the limiting stop surface of the radial cam 9, along springy section 10, are notches 12, 13, 14, which may have differing depths. Because of the springy characteristics of section 10, the bearing pivot 8 is forceably urged to drop into and stay in the next notch 13, when the visor is moved in the direction of the arrow according to FIG. 2. With continued rotation of the visor, bearing pivot pin 8 is moved into the last notch 14, whereupon the visor is completely folded up and open, as shown in FIG. 4. The first notch 12 defines the closed position of the visor.

Instead of the inherent elasticity of the disk cam 5, other resilient means, for example mechanical springs, may be provided. Such means can bear in on the disk cam, in a similar manner to that shown. In FIG. 3, the control pivot pin 8 and the bearing pivot pin 4 project sufficiently deeply into the disk cam 5 that they are effectively axially fixed. This is true becuase the preshaped visor 3 has a normal tension in a direction axially along control pivot pin 8 and bearing pivot pin 4. No special axial retaining device is absolutely required. According to the alternative embodiment of the invention shown in FIG. 5, the disk cam 5' has a recess 15 just inside its circumference, and defines a curved elastic marginal flange 16. Flange 16 provided with notches 12, 13, 14 on its outer circumference. The bearing pivot 4, as well as the corresponding opening 7', is thereby located in the center of disk cam 5, whereby the control pivot 8 can again lock in the elastic notches in differing visor positions as required.

Figure 13:
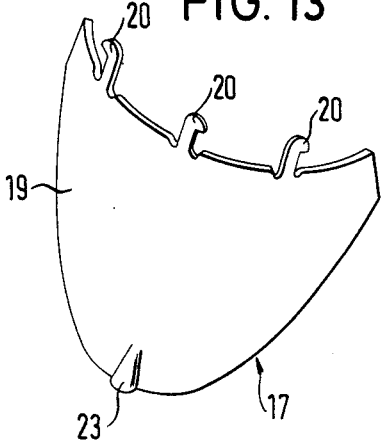
Figure 14:
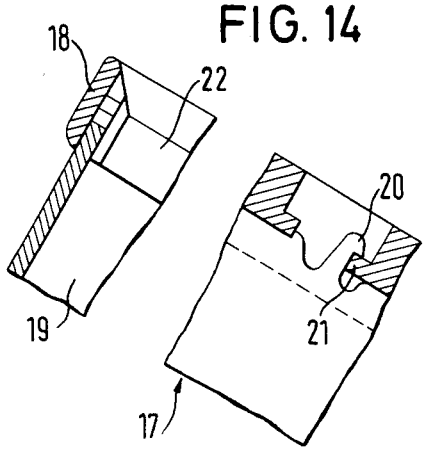
Figure 12:
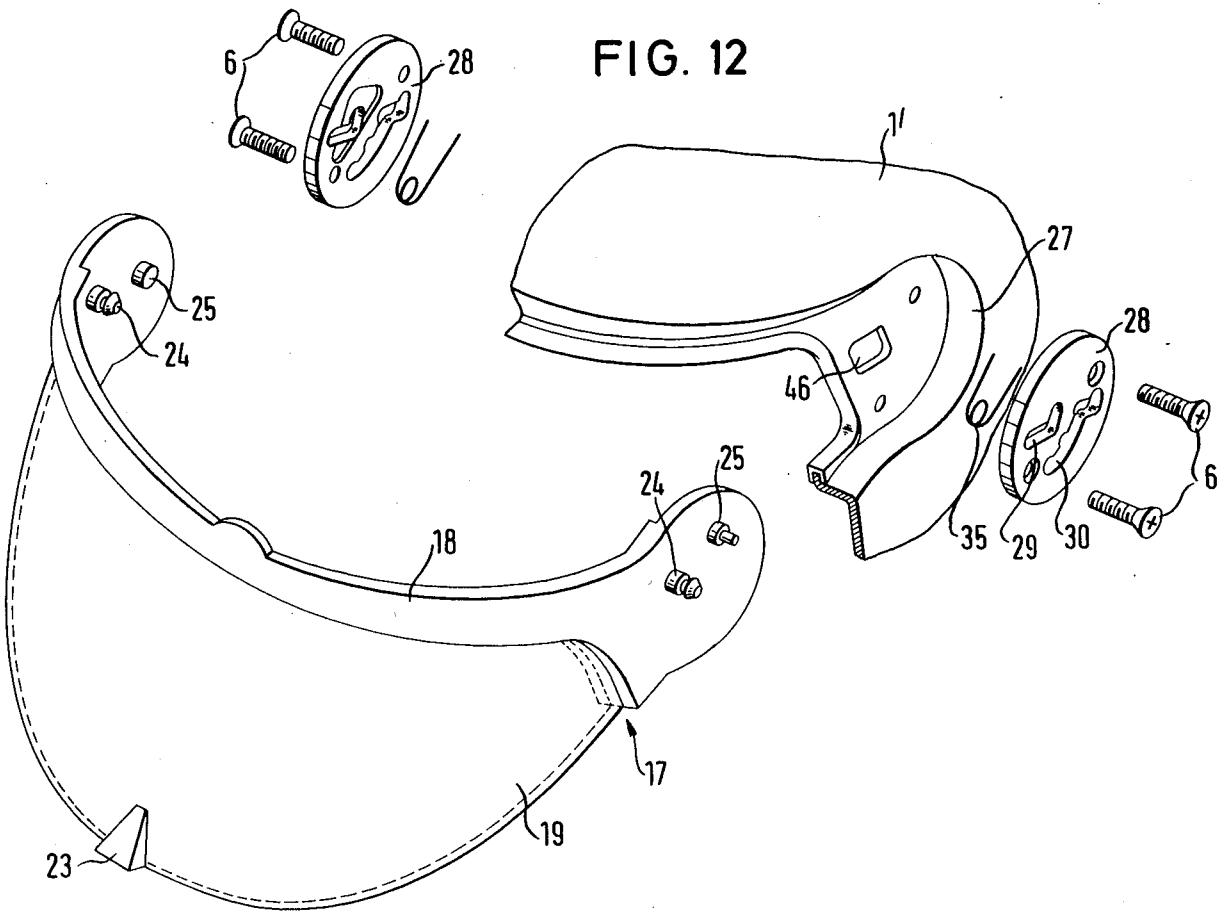

FIG. 6 shows a side view of the safety helmet according to the invention, in a different shape. As shown in FIG. 6, the visor 17 in its closed position is received in an indentation defined around the edges of cutout 2' for the user's face. The visor resides flush with the surface of the shell when the visor is closed. In this embodiment, as is shown particularly in FIGS. 12, 13 and 14, the visor 17 has an essentially U-shaped frame 18, for example of flexible plastic material, as well as a frontal curved transparent visor panel 19. Visor panel 19 is connected to frame 13 by means of a simple hook arrangement, for which visor panel 19 has springy notch projections 20. Projections 20 are hooked into corresponding notch elements or edges 21 at openings 22 in frame 18. Accordingly, panel 19 is detachable from frame 18 and can be easily interchanged or exchanged. Located at the center of the panel's bottom surface is a holding handle 23 for the user to manually engage the visor panel.

Formed on each side of the legs of U-shaped frame 18, and spaced at a distance from one another, are bearing pivot pin 24 and control pivot pin 25. On the edge of the cutout 2' for the user's face, the helmet shell 1' has a slightly indented edge 26, at which the visor 17 in its closed position rests at a position essentially flush with the outer surface of shell 1'. The respective positions of the visor are illustrated in FIG. 6. In closed position, shown in solid lines in FIG. 6, the visor 17 does not project above the outer surface of shell 1'. FIGS. 7–10 illustrate the particulars of the control unit or control elements for the guided movement of the visor 17. The visor is movable from the closed flush position in FIG. 6 (solid lines) into one or more opened positions (dotted lines in FIG. 6) and is also positionable at an intermediate venting position (dash-dot lines). For this purpose, each disk cam 28, located at a recess 27 of the helmet shell 1' and fastened to the shell with screws 6, has essentially L-shaped radial cam surfaces. The bearing pivot pin 24 is located and guided in a radial cam slot 20. Similarly, the control pivot pin 25 is located and guided in a substantially circumferential slot 30, also having a radial section.

Figure 10:
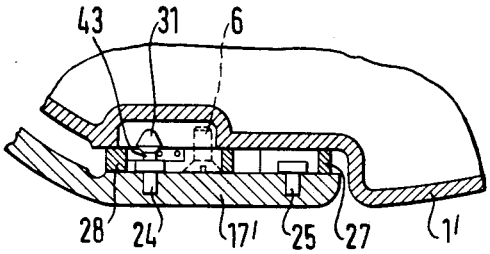
Figure 10:
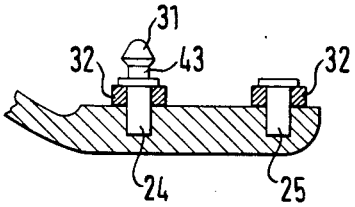

As shown in FIG. 10, at least the bearing pivot pin 24 projects above the radial cam 29 in the disk cam 28 and has a support 31 on its protruding end, which prevents the bearing pivot pin 24 from slipping out of its controlling guideway. In the embodiment according to FIG. 10', the bearing pivot pin 24, as well as the control pivot pin 25, have easy action rollers 32, by which the controlling movement in the slots of cams 29 and 30 is smooth. As shown especially in FIGS, 7–9, radial cam 29 extends in the direction of the cutout 2' for the user's face. On its rear end, this radial cam 29 has a fixed position detent in the shape of notch 33, defining a receptacle for pin 24 in the closed position of visor 17.

Figure 9:
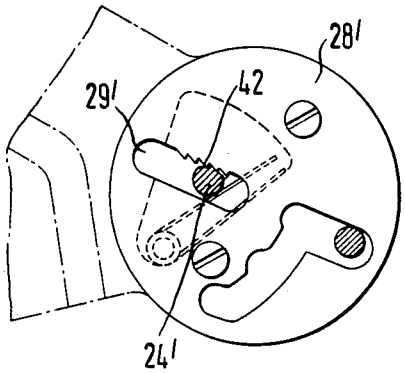
Figure 5:
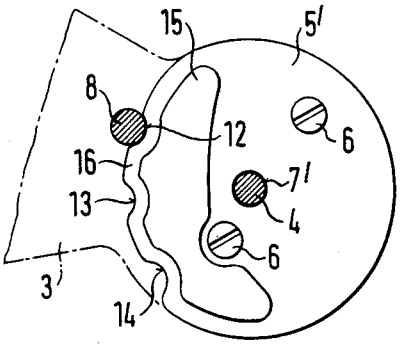

If the visor 17 is moved to its opened position and folded upwardly, then as shown in FIGS. 8 and 9, the bearing pivot 24 moves foward and is located close by, but is not completely at the front end of radial cam 30. The radial part of cam 30 for pin 25 proceeds approximately parallel to radial cam 29 for pin 24. On the circumferential part of cam 30 concentric with the bearing pivot 24, the radial cam 30 is provided with detent notches 34, 35, 36, in order to fix the visor 17 at differing tilting positions.

Figure 11:
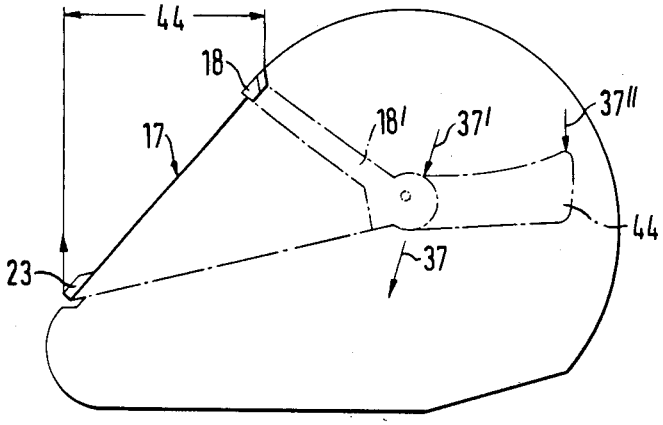

The structure of the helmet and visor positioning means, and a number of alternative embodiments, are evident with respect to the particulars of operation. If the visor 17 is pushed upwardly by pushing the handle 23 of the panel 19, toward the direction of the arrow shown in FIG. 6, the frame 18 of the visor bears near its center against the indented flange 34 of the helmet shell 1'. This pressure causes the outer ends of frame 18' to be forced downwardly in the direction of the arrow 37 shown in FIGS. 6 and 11. The bearing pivot pin 24 thereby moves out of its detent location at notch 33 and the complete visor 17 advances outwardly from flange 26 due to the force of an essentially V-shaped spring 35 pressing upwardly and forwardly against pin 24. By virtue of this movement, the visor panel 19 is vented slightly, i.e., spaced slightly from shell 1', as is shown by dash-dot lines in FIG. 6. Venting is therefore accomplished by means of a slight lifting movement according to FIG. 6.

With further lifting movement of the visor panel and frame, in the direction of arrow 36, the visor can be rotated to its uppermost opened position. The radial or non-concentric section of cam 30 define a wide area near the top of cam 30, so that the control pivot pin 25 and/or bearing pivot pin 24 can latch (as in FIG. 7) when the visor is tightly closed. The control pivot pin 25 is positioned at a distance b from the bearing pivot pin 24. If the visor 17 moves downwardly at the ends of its legs in the direction indicated by arrow 37, the bearing pivot pin 24 clears detent 33 in slot 29 and is pushed forward by means of spring 35. Therefore the visor is vented by a spacing a as shown. Because of the inclined plane of the disk cam 30, the control pivot pin 25 also moves downwardly, so that a parallel position of the visor panel when vented, as compared to the initial position of the visor panel, is maintained. Any other desired setting angle can be obtained through corresponding pitch of the inclined plane along which pin 25 rests.

At the venting position it is advantageous to make slot 29 narrow and provide a notch 39 for pin 25 in slot 30, so that this venting position is maintained. The excess length of the radial cam 29 as shown ensures that the spring 35 in this position securely holds the visor 17 in fixed position. Along the concentric section of the radial cam 30 are provided additional positioning notches 40 and 41. According to requirements, these notches can be made deeper or shallower, such that differing regulating power is obtained to resist movement of visor 17 from the detents defined by the notches. FIG. 19 shows the layout in open position of the visor 17. To close the visor, the visor frame and panel are tilted downwardly and at the lowermost position of the visor (the venting position) the whole visor is closed by moving it inwardly towards the user's head. During this process, for example, the control pivot pin and bearing pivot pin automatically move into the tight closing position and thereby into the initial starting position (as shown in FIG. 7), in which the visor frame and visor panel rest against edges 26 of helmet shell 1'.

In the embodiment according to FIG. 9', the disk cam 28' is shaped very similarly to the radial cam according to FIGS. 6–9. However, the upper limiting edge of the radial cam surface 29' has a locking serration. In this area, the bearing pivot pin 24' can be stopped at any of a number of closely-spaced locations, for which purpose cam surface 29' is equipped with notched points. When venting the visor, many closely adjustable spacings can be accomplished.

FIG. 10 also illustrates that a recess 43 can be provided behind a cone-shaped point of the bearing pivot pin 24. The pin has a large end defining a recess 43 to which the leg of the spring 33 locks and thereby axially positions and secures the bearing pivot pin 24. In this instance it is not required to shape the point of the pivot pin as an enlarged end, but in FIG. 10' such a recess is indeed defined in between the end and the track roller 32. Because of this shape, the visor 17 can additionally be axially secured on both sides.

The frame 18 and the visor 17 define the contact surface 34, approximately at the center of the helmet, such that upon movement in the direction of the lever arm 34, a transition point forms, which causes the ends of visor 17 to be lowered, thereby moving them relative to the disc cam in the direction 37. The same effect can also be achieved if pressure is exerted directly on the end of the visor frame in direction 37'. According to another embodiment, the possibility exists in that the frame 18' can be elongated in a spoiler-type shape at 44, in accordance with FIG. 11. Therefore, by pressing in direction 37', the opening process is initiated more directly and at the same time, through continued pushing downwardly at 37'', upward swivel movement of the visor takes place. It can also be seen from FIG. 12 that on the sides of the helmet shell 1', stop surfaces can be provided to fasten the discs via screws 6. The sides have recesses 46 which are provided for the elongated top of bearing pivot pin 24 and/or guide pivot pin 25. Also provided on the surface 45 are threaded holes 47 for the screws 6. The springs 35, which are shaped as leg sections, are inserted before the disc cams 28 are affixed. By lightly pulling the frame ends of the visor 17 part, the frame can be snapped in and made operational. The disc cams 28 are shaped such that the recesses for the springs 35 in the disc cam point against the surfaces 45.

In the operating example according to FIG. 6, the visor has a tilting-type cam in the center of the helmet, which interacts with the edge of the cutout for the user's face. The center defines a tilting-point cam at the center of the helmet when the visor is lifted. The bearing pivot pin 24 thereby moves outside the recess of the detent notch 33 and can, together with the visor, be moved the desired amount along the radial cam 29, while the control pivot pin 25 is likewise moved along its radial cam 30. This design is advantageous if the visor is of relatively stiff shape. Assuming that the same disc cams with radial slot sections and the like are placed on both sides of the helmet, control movement and venting movement normally take place on both disc cams, even if the visor 17 is not grasped exactly in the center, or lifted evenly, but is more or less off-center. In that case, the movement of the hand is transmitted to both sides of the helmet. Difficulties can arise, however, if the visor 17' consists of very light plastic material and is relatively unstable and easily bendable.

If the visor is not operated evenly or exactly in the center along direction 60 as shown in FIG. 15, then the tilting movement, as defined for example by movement of the pivot pins and the direction of lifting, can take place only on one side. This leads to a blockage when the visor is tilted unevenly upward, because the bearing pivot pin on one side has not as yet left its detent location and becomes unable to leave it as the movement proceeds only upward along direction 60. To prevent this occurrence according to a further embodiment of the invention, the means to perform tilting of the visor is equipped with a tilting cam 61, effective even if the visor is moved off center, or if the visor is of a relatively unstable and bendable material. The cams 61, like pins 24, are spaced symmetrically on both sides of the cutout in the shelf for the user's face. A lever arm distance c d, being defined between such means and the point on the visor where the user grasps manually.

In the embodiment according to FIGS. 16–19, each side of the visor 17 has a tilting cam 61 and each tilting cam engages in a recess 62 of the helmet shell 1'. FIG. 19 shows a sectional view of the recess 62, which has a supporting or guiding surface 63 on its upper edge. According to this example the tilting type cams are protrusions of the ridge like edge 64 of the visor. The layout and shape of the disc cam 28 with radial cams, bearing pivot pins and control pivot pins are otherwise similar to FIGS. 6–9. In the closed position of the visor 17', the tilting type cams 61 engage with some play in recesses 62. If the visor 17' is now operated in direction 60 according to FIG. 15, then, as shown in the example, at lest one of the tilting type cams, such as the right cam in FIGS. 16 and 17, supports itself on the corresponding supporting surface 63 of the recess 62, so that the bearing pivot pin 24 is released. When the bearing pivot pin 24 is released, for example by pressure in direction 37 of FIG. 7 or as in FIG. 6 by the leverage means described above, the visor 17' is then allowed to move outwardly on that side, becoming spaced by the venting space 65. Accordingly, on this side the tilting type cam 61 becomes spaced at a distance 66 from the outer helmet shell. By pressing the visor 17' further, the same process is repeated for the oppoiste side of the helmet. In particular, the tilting type cam 61 disengages and is unlocked from the visor 17', that side becoming vented by springs 35 in accordance with FIGS. 6–9 in the same manner and by the same measure, namely distance 65. The visor 17' then is positioned parallel to its initial closed position and can be tilted upwardly into an open position without difficulty.

In the embodiment according to FIGS. 20–22, the bearing pivot pin 24 functions as the tilting cam, on both sides of the helmet shell 1'. The tilting cam end recesses are deleted according to the example described above. The only difference in the embodiment of FIGS. 20–22 as compared to FIGS. 6–9 is that cam 30' has a radial section with a fixed position detent notch 67, shaped as a semi-circular recess for the control pivot pin 25', in which detent the control pivot pin 25' rests and is held in the closed position of the visor 17'. The other cam 29' has a radial section with a smooth, uninterrupted track 68, on which the control pivot 24' is supported. Track 68 defines an inclined path for pin 24, resulting in a relative displacement of pins 24', 25' when the visor is pushed to the rear. If the visor 17'' is tilted in direction 60 according to FIG. 15, the bearing pivot pin 24' rides along on the above mentioned track 68, so that the rear control pivot pin 25 is moved downwardly and out of its fixed position notch 67. The spring 35 presses the visor 17'' simultaneously on both sides, or first on one side and then on the other, moving the visor into the venting position according to the dotted line illustration in FIG. 15. When further tilted upwardly the visor reaches the control position of FIG. 22, and again latches in the open position.

Figure 23:
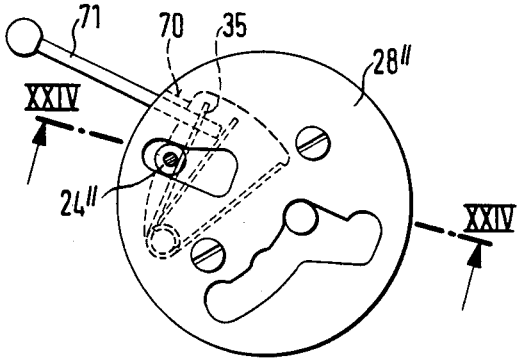
FIGS. 23 and 24 show a further alternative, FIG. 24 being a section view taken along lines XXIV—XXIV in FIG. 23.
Figure 24:
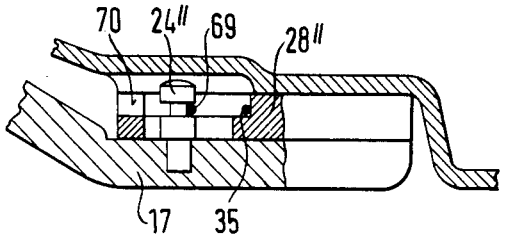

FIGS. 23 and 24 illustrate an alternative embodiment regarding the mounting of visor 17. In this embodiment, means are provided to prevent the loosening of visor 17 from the helmet shell, even during rough handling. According to the embodiment of FIGS. 10 and 10', the bearing pivot 24 projects over the disc cam. However, the bearing pivot 24' according to FIGS. 23 and 24 has a notch 69, which extends only within the material thickness of the disc cam 28'. In accordance with the figures, the spring 35 locks into this recess 69, also within the material thickness. To release the connection, the disc cam 38' has a small opening 70 at the height of the recesss 69, into which a tool, for example a match 71 can be inserted. With this tool, the leg of spring 35 can be pushed out of the recess 69, as shown in FIG. 23, for disengagement of the visor and helmet shell.

I claim:

1. A safety helmet, comprising:

a helmet shell having a face cutout;

a visor which is hingeably supported on both sides of the cutout on means defining a hinge axis and can be translated radially of the hinge axis outwardly from the shell from a tightly closed position to a tilting position, tilted circumferentially about the hinge axis, and locked by a control means at least in a first position in front of the cutout and a second position above the cutout, one of the visor and the shell having a fixed pivot pin and the control means being fixed to the other of the visor and the shell; and the control means acting radially relative to the hinge axis and having a control element received in a detent defining the tightly closed position, the control means having an elongated slot receiving the pivot pin and controlling tilting movement of the visor, whereby the visor can be sealed, vented and positioned at least at two extreme positions.

2. A safety helmet according to claim 1, wherein the control means comprises at least one radial cam and at least one pivot means, which is guided in the radial cam.

3. A safety helmet according to claim 2, comprising at least one disk cam for supporting the control element.

4. A safety helmet according to claim 3, comprising a disk cam in which the radial cam is formed, the stop notches being formed along the radial cam, and that part of the disk cam having the stop notches has elastic characteristics.

5. A safety helmet according to claim 3, wherein the disk cams are mounted in recesses formed in the helmet shell.

6. A safety helmet according to claim 3, wherein the visor is U-shaped and elastic and can be locked for movement with the disk cams by snap connectors.

7. A safety helmet according to claim 6, wherein the pivot means are formed integrally with the visor.

8. A safety helmet according to claim 2, wherein the at least one radial cam is provided with stop notches, into which the pivot means is flexibly and selectably lockable, thereby defining graduated tilting positions.

9. A safety helmet according to claim 8, wherein the stop notches have different depths.

10. A safety helmet according to claim 2, comprising one adjustable pivot means and a control pivot with corresponding radial cam, which controls the tilting movement of the visor, provided at least on one side of the helmet.

11. A safety helmet according to claim 10, wherein the pivot means engages in control recesses formed in the disk cam.

12. A safety helmet according to claim 11, wherein the pivot means projects over and is supported over the disk cam.

13. A safety helmet according to claim 12, wherein the pivot means comprises a recess located within the disk cam and the support comprises a spring engageable in the recess.

14. A safety helmet according to claim 13, wherein the disk cam has an opening in the recess on in the disk cam, into which a stop releasing tool can be inserted.

15. A safety helmet according to claim 1, wherein the pivot means comprises rollers.

16. A safety helmet according to claim 1, wherein the control means include a bearing pivot around which the visor is tiltable and a radial control pivot, guided in a radial cam substantially concentric with the bearing pivot.

17. A safety helmet according to claim 16, wherein the bearing pivot and the control pivot are translatable in cam slots oriented to guide the visor between the tightly closed position and the vented position.

18. A safety helmet according to claim 17, wherein a cam slot for the bearing pivot extends in a direction toward the cutout for the face and permits venting of the visor in the closed position, the detent being a notch in the cam slide for the bearing pivot, and the radial cam for the control pivot extends concentrically to the venting position of the bearing pivot and has stop locations formed by notches in the radial cam.

19. A safety helmet according to claim 18, comprising a handle for grasping the visor and a contact surface on the visor, the contact surface interacting with an edge of the cutout for the face, and being operable to temporarily form a swivel axis to force at least one of the bearing pivot and the control pivot out of a notch defining the detent for the tightly closed position and thereby release the visor from the tightly closed position.

20. A safety helmet according to claim 19, further comprising a spring pressing the bearing pivot toward the venting position, the spring moving the visor to the venting position when the bearing pivot is released from the detent.

21. A safety helmet according to claim 20, wherein the radial cam for the bearing pivot is longer than required for the opened position of the bearing pivot and the other concentric radial cam exhibits stop notches on its curved edges facing the bearing pivot, the control pivot being pressed into the stop notches by a spring.

22. A safety helmet according to claim 21, wherein the radial cam comprises serrated stop notches for the bearing pivot.

23. A safety helmet according to claim 22, wherein the visor comprises a U-shaped frame and a detachable front visor panel.

24. A safety helmet according to claim 23, wherein the visor panel comprises elastic stop hooks and the frame comprises stop-members for engagement with the stop hooks.

25. A safety helmet according to claim 18, comprising a tilting cam on opposite sides of the helmet respectively, each positioned at a lever distance from the front edge of visor and each of which forms a swivel axis to vent the visor.

26. A safety helmet according to claim 25, wherein the tilting cams engage into recesses of the helmet shell which form a supporting surface for each, at which the corresponding tilting cam is temporarily supported, while the visor is vented and is then released from the recess by the control movement and thereby enables tilting of the visor into opened position.

27. A safety helmet according to claim 25, wherein the radial cam for the control pivot defines a fixed position for the control pivot within which it is retained in closed visor position and the other raidal cam defines an uninterrupted track for the bearing pivot and the bearing pivot forms the tilting cam of the visor.

28. A safety helmet according to claim 1, wherein the control means comprises a stop location, into which the visor engages during light venting.

29. A safety helmet comprising:

a helmet shell having a face cutout;

a visor which is hingeably supported on both sides of the cutout on means defining a hinge axis and can be translated radially of the hinge axis outwardly from the shell from a tightly closed position to a tilting position, tilted circumferentially about the hinge axis, and locked by a control means at least in a first position in front of the cutout and a second position above the cutout, one of the visor and the shell having a fixed pivot pin and the control means being fixed to the other of the visor and the shell; and, the control means acting radially relative to the hinge axis and having a control element received in a detent defining the tightly closed position, the control means having an elongated slot receiving the pivot pin and controlling tilting movement of the visor, whereby the visor can be sealed, vented and positioned at least at two extreme positions, the control means having a radially-acting notched cam surface for holding the visor in the tilting position and a transversely-acting notched cam surface for holding the visor in the tightly closed position, the control means being translated between the radially-acting and transversely-acting cam surfaces when moving the visor from the tightly closed position to the tilting position.

* * * * *